US006078344A

United States Patent [19]

Wen et al.

[11] Patent Number: 6,078,344

[45] Date of Patent: Jun. 20, 2000

[54] RESISTIVE THERMAL PRINTING APPARATUS AND METHOD HAVING A NON-CONTACT HEATER

[75] Inventors: Xin Wen; Teh-Ming Kung; David A. Johnson, all of Rochester, N.Y.

[73] Assignee: Eastman Kodak Company, Rochester, N.Y.

[21] Appl. No.: 08/927,782

[22] Filed: Sep. 11, 1997

[51] Int. Cl.[7] ..... B41J 2/315

[52] U.S. Cl. ..... 347/212

[58] Field of Search ..... 347/212, 177, 347/185, 186, 197, 200, 209, 213, 102

[56] References Cited

U.S. PATENT DOCUMENTS

| | | | |
|---|---|---|---|
| 4,912,486 | 3/1990 | Yumino | 347/212 |
| 4,966,464 | 10/1990 | Matoushek | 347/212 |
| 4,972,206 | 11/1990 | Matoushek | 347/212 |
| 5,053,792 | 10/1991 | Une | 346/146 |
| 5,113,201 | 5/1992 | Mano et al. | 347/187 |
| 5,172,130 | 12/1992 | Takahashi | 347/13 |
| 5,206,477 | 4/1993 | Stephenson | 219/216 |
| 5,266,970 | 11/1993 | Stephenson | 347/215 |
| 5,288,689 | 2/1994 | Simpson et al. | 503/227 |
| 5,457,082 | 10/1995 | Simpson et al. | 503/227 |
| 5,466,658 | 11/1995 | Harrison et al. | 503/227 |
| 5,523,274 | 6/1996 | Shuttleworth et al. | 503/227 |
| 5,534,478 | 7/1996 | Bowman et al. | 503/227 |
| 5,541,636 | 7/1996 | Ingram | 347/212 |
| 5,553,951 | 9/1996 | Simpson et al. | 400/120.18 |
| 5,754,208 | 5/1998 | Szlucha | 347/102 |
| 5,757,407 | 5/1998 | Rezanka | 347/102 |

*Primary Examiner*—N. Le
*Assistant Examiner*—Judy Nguyen
*Attorney, Agent, or Firm*—Walter S. Stevens

[57] ABSTRACT

Printer apparatus and method for printing an image on a receiver, the printer having a non-contact heater for improving image protection and image stability on the receiver. The printer comprises a printhead for transferring a colorant to the receiver and a heater disposed in heat transfer communication with the receiver for heating the receiver, so that the colorant diffuses into the receiver. The heater is located adjacent to the receiver. The heater comprises a heating element capable of emitting radiant heat therefrom and includes a reflector oriented with respect to the heating element and the receiver so as to reflect heat from the heating element to the receiver. The heater also comprises a heater control arrangement connected to the heating element for controlling the heating element. Moreover, the heater may further include a temperature sensor disposed relative to the receiver to more accurately control the receiver temperature, by controlling the heater in response to the temperature sensed by the temperature sensor. A receiver transport mechanism capable of engaging the receiver and transporting the receiver adjacent the heater is also provided.

38 Claims, 3 Drawing Sheets

RESISTIVE THERMAL PRINTING APPARATUS AND METHOD HAVING A NON-CONTACT HEATER

FIELD OF THE INVENTION

The present invention generally relates to digital printing apparatus and methods and more particularly relates to a resistive thermal printer apparatus and method having a non-contact heater for eliminating image artifacts.

BACKGROUND OF THE INVENTION

A resistive thermal printer typically comprises the following components: a thermal printhead having an array of selectively-activated thermal elements that can transfer dyes from a dye donor to a dye receiver in an imagewise fashion, a pressure interface or "nip" formed between a platen and the printhead which sandwich the dye donor and the dye receiver extending through the nip, a transport mechanism for transporting the dye receiver, a transport mechanism for transporting the dye donor, and electronics for mechanical and printhead control, as well as electronics for control of data path and image processing. The dye donor is normally supplied in rolls of yellow, magenta, cyan, and sometimes black color patches. The dye receiver may be in cut sheets or rolls of paper or transparency.

Various dye chemistries are used for thermal dye transfer printing. For example, it is known that a deprotonated cationic dye can be used for transfer to an acid-containing thermal receiver. In this case, the deprotonated cationic dyes are in neutral form. After the dyes are transferred to the thermal receiver, they undergo a protonation process during which the dye molecules are reprotonated by acidic moiety to become cationic. Such dyes that undergo deprotonation-reprotonation conversions are disclosed in detail in U.S. Pat. No. 5,523,274 titled "Thermal Dye Transfer System With Low-$T_g$ Polymeric Receiver Containing An Acid Moiety" issued Jun. 4, 1996 in the name of Leslie Shuttleworth, et al. This class of dyes is referred to herein as NONICAT dyes. In addition, the terminology dye conversion is used herein to refer to the protonation of the deprontonated cationic dye molecules of the NONICAT dyes. The dyes transferred to the thermal receiver are anchored onto and form a strong electrostatic bond with the acidic moiety in the receiver. The protonating action also causes a hue shift of the transferred dyes from a deprotonated dye form to a protonated dye form. In practice, it is desirable to complete the protonation process at a rapid rate. However, dye stratification readily occurs near the surface of a dye-receiving layer due to the previously mentioned dye-receiver protonating action which prevents subsequent dyes from easily diffusing into the dye-receiving layer. Moreover, a sizable amount of transferred NONICAT dyes stay near the surface of the dye-receiving layer and remain unprotonated. Hence, it is desirable to increase dye conversion rate and diffusion of dyes into the dye receiver when using NONICAT dye chemistry. Therefore, a problem in the art is slow dye conversion rate and slow diffusion of dyes into the dye receiver when using NONICAT dye chemistry.

Another problem associated with thermal resistive printing is inadequate protection against finger prints, dye retransfer, physical abrasion, and image instability. In the prior art, many dye receiving layers, unlike the above described layers using NONICAT dye chemistry, are hydrophobic. Such dyes can be readily dissolved by oil or grease present on the fingers of an operator of the printer. Thus, finger prints can easily form on a finished print. The finger print problem has historically been addressed by two methods. In the first method, a lamination layer is printed by the printhead on top of the transferred dye image as the last step in printing on the receiver. The lamination layer protects the dyes from being in direct contact with the surrounding environment. The disadvantage of the lamination method is the increased operation time for the printing process as well as additional cost of the media.

The second method of addressing finger prints formed on a finished print uses an additional heater to heat the receiver after printing. As disclosed in U.S. Pat. No. 4, 966,464 titled "Fusing Apparatus For Thermal Transfer Prints" issued Oct. 30, 1990 in the name of Robert J. Matoushek, such prior art heaters are in the form of heated fuser rollers that press against the thermal receiver. This pressurized heating causes the dye near the receiver surface to diffuse into the dye receiving layer, which diffusion reduces the probability of the dye coming into contact with external oil or grease. One disadvantage of these prior-art heaters and fuser rollers is that physical contact occurs between the heated roller and the dye receiver. In this regard, imaged dyes transferred to the dye-receiving layer may transfer back out and into the fuser roller. Thus, transfer of dyes into the fuser roller contaminates subsequent image printing. A further disadvantage associated with this prior art technique is that the heated pressure contact between the fuser roller and the printed image of the receiver produces image artifacts such as scratches and blisters (i.e., ruptured vapor bubbles) on the image-bearing surface of the receiver.

Therefore, there has been a long-felt need for providing a thermal resistive thermal printer apparatus and method that is free of the above cited disadvantages and problems.

SUMMARY OF THE INVENTION

The invention resides in a printer apparatus and method for printing an image on a receiver, the printer being equipped with a non-contact heater for heat treatment of the printed receiver. The printer comprises a printhead for transferring a colorant to the receiver and a heater disposed in heat transfer communication with the receiver for heating the receiver, so that the colorant diffuses into the receiver. The heater is located adjacent to the receiver. The heater comprises a heating element capable of emitting radiant heat therefrom and includes a reflector oriented with respect to the heating element and the receiver so as to reflect heat from the heating element to the receiver. The heater also comprises a heater control arrangement connected to the heating element for controlling the heating element. The heater may further include a temperature sensor disposed adjacent to the receiver to accurately control the receiver temperature by controlling the heater in response to the temperature sensed by the temperature sensor. A receiver transport mechanism capable of engaging the receiver and transporting the receiver adjacent the heater is also provided.

An object of the present invention is to accelerate the protonation of NONICAT dye molecules in a dye receiver without scratching or blistering the dye receiver.

Another object of the present invention is to provide an economical method for the protonation of NONICAT dyes in thermal receivers.

A feature of the present invention is the provision of a heating element associated with a reflector that reflects radiant heat energy from the heating element and onto the dye receiver to diffuse dye into the receiver.

An advantage of the present invention is that protonation of NONICAT dyes is accelerated in the thermal receiver.

Another advantage of the present invention is that protection and stability of the printed image is improved.

A further advantage of the present invention is that media cost and printing time are reduced.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

Figure 1:
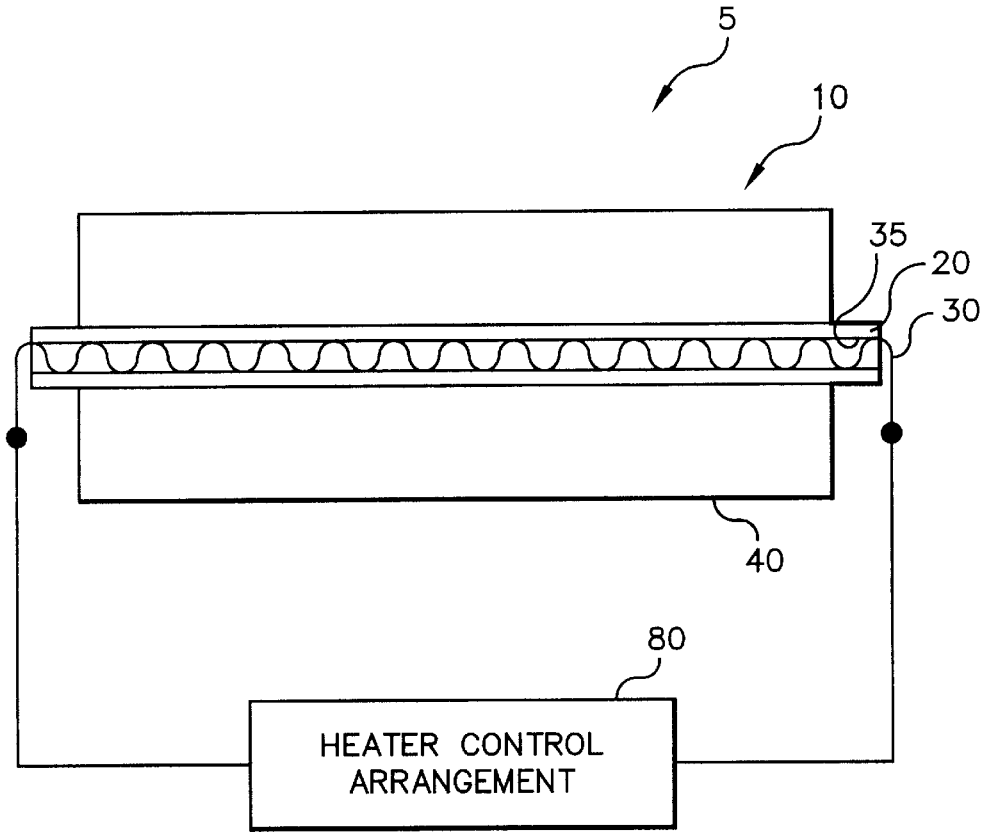
FIG. 1 is a plan view in section of a thermal resistive printer, with parts removed for clarity, comprising a radiant heater and a reflector according to a first embodiment of the invention.
Figure 2:
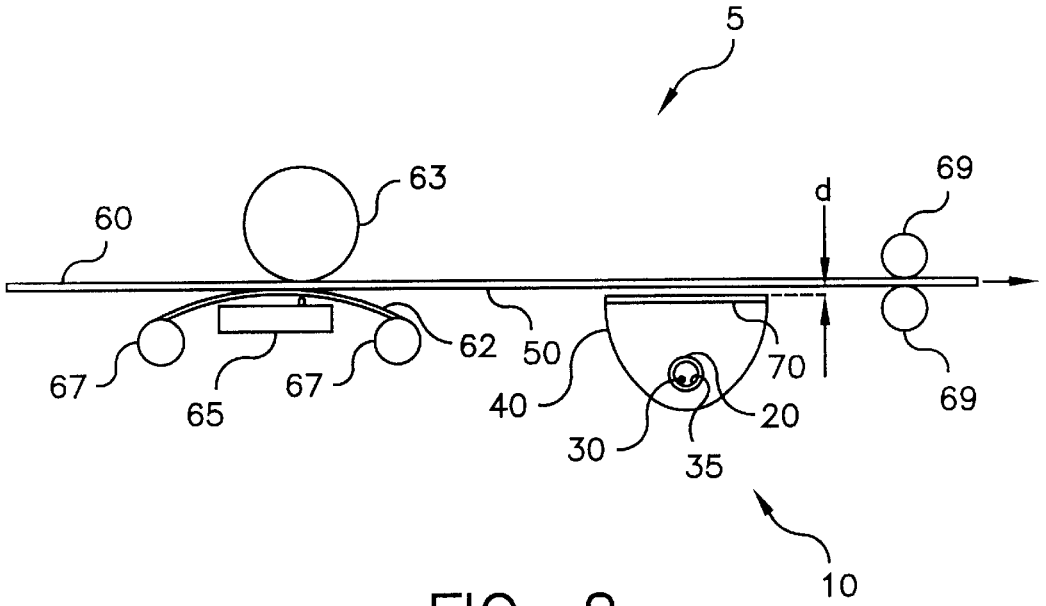
FIG. 2 is a view in elevation of the thermal resistive printer including the non-contact heater according to a first embodiment of the present invention.

Referring to FIGS. 1 and 2, a resistive thermal printer apparatus, generally referred to as 5, comprises a non-contact radiant heater, generally referred to as 10, for accelerating dye conversion while simultaneously avoiding production of image artifacts commonly associated with fuser rollers (not shown) belonging to the prior art. In a first embodiment of the invention, heater 10 comprises a shield, such as a tube 20, preferably made of quartz, surrounding a spirally wound heating element 30, such as a coiled electrically resistive wire, which passes through a cylindrical bore 35 formed through tube 20. Heating element 30 is surrounded by tube 20 for protecting heating element 30 from damage. Tube 20 also provides physical support to the entire length of the heater element 30. In addition, tube 20 electrically insulates heater element 30 from its surroundings and protects the heater element 30 from damaging other components belonging to non-contact radiant heater 10. The materials selected for heating element 30 and tube 20 should evince durability at high temperature through a multiplicity of thermal cycles. Examples of such materials suitable for use as heating element 30 are "NICHROME", a Nickel-Chromium Alloy, in addition to iron chromium aluminum alloys. "NICHROME" is a trademark of Driver-Harris Company located in Harrison, N.J. Tube 20 may be quartz. It is appreciated by a person of ordinary skill in the art to which the present invention pertains that metal sheathed heating elements or exposed wire heaters may also be used. Electrical current flowing through heating element 30 causes heating element 30 to heat, thereby generating radiant heat emanating therefrom.

Referring again to FIGS. 1 and 2, a generally parabolic-shaped reflector 40 made of a substantially reflective material, such as polished aluminum, partially surrounds tube 20 and is oriented at an angle so as to reflect the radiant heat energy onto an image side 50 of a receiver 60. Reflector 40 preferably reflects the heat at a high thermal efficiency ratio. As used herein, the terminology "thermal efficiency ratio" is defined to mean the quantity of heat energy reaching receiver 60 divided by the quantity of total heat energy emitted by heating element 30. Moreover, disposed opposite receiver 60 is a dye donor ribbon 62 containing dye therein to be diffused into receiver 60. Dye donor ribbon 62 is transported past a resistive thermal printhead 65 by a dye donor transport mechanism 67, which resistive thermal printhead 65 is disposed in contact with dye donor ribbon 62. In order to perform its heating function, printhead 65 includes a plurality of thermal resistive elements (not shown) for heating dye donor ribbon 62 to force the dye contained therein onto and into receiver 60. Receiver 60 is supported by platen roller 63 which, together with printhead 65, provides pressure contact at an interface defined between print head 65 and donor ribbon 62, and also at an interface between donor ribbon 62 and receiver 60.

As best seen in FIG. 2, the parabolic shape of reflector 40 assists in efficiently reflecting substantially all of the heat radiated by heating element 30 onto image side 50 of receiver 60. Receiver 60 is transported past reflector 40 by receiver transport mechanism 69 to suitably expose image side 50 to the radiant heat energy emitted by heating element 30. Preferably, dye donor ribbon 62 and receiver 60 are transported in the same direction and at the same speed to provide a properly registered image on receiver 60. A substantially heat transparent protective cover 70 is disposed across an open side (as shown) of parabolic-shaped reflector 40. Protective cover 70 may be a metal screen or sheet metal with punched holes for preventing receiver 60 from inadvertently contacting tube 20 while simultaneously allowing a sufficient quantity of radiant heat flux to pass therethrough. In this regard, protective cover 70 maximizes transmission of radiant energy to receiver 60 while simultaneously minimizing opportunity for any foreign object to contact tube 20. In addition, a distance "d" is preferably maintained between protective cover 70 and receiver 60 to preclude inadvertent contact between cover 70 and receiver 60, so that receiver 60 is not scratched as receiver 60 is transported past cover 70. It should be noted, however, that the distance "d" defined between cover 70 and receiver 60 is not critical to the present invention.

Figure 3:
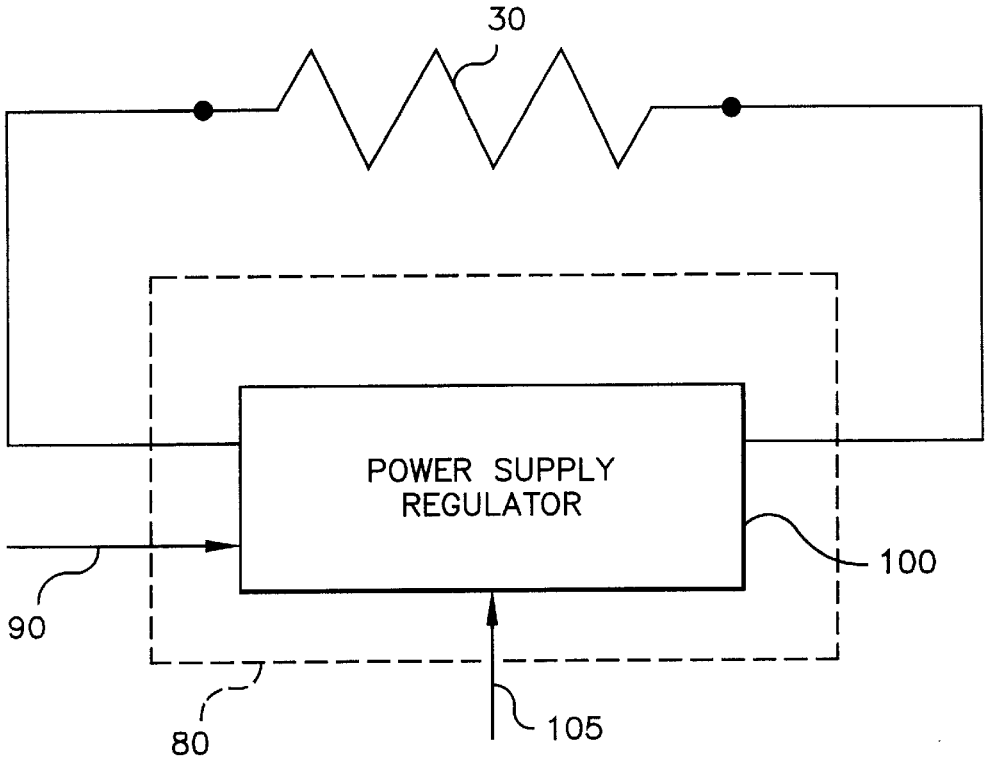
FIG. 3 is a schematic showing a first embodiment heater control arrangement for the radiant heater and reflector.

Turning now to FIG. 3, a first embodiment heater control arrangement, generally referred to as 80, is there shown for controlling the heat generated by heating element 30. In this regard, a power line 90, such as an alternating current 120 VAC power line, is connected to an input of a power supply regulator 100. Power supply regulator 100 converts the input voltage to a direct or an alternating current or voltage supplied to the heating element 30 according to the manufacturer's specification for heater element 30. A plurality of control signals 105 applied to power supply regulator 100 is used to change the power delivered to heating element 30, or alternatively inhibit heating of heating element 30 when printer 5 is not in use. Thus, power supply regulator 100 provides means for regulating the voltage, current, and/or power delivered to heating element 30 in a manner such that power regulation is substantially independent of variations of voltage input to power supply regulator 100. However, it is appreciated that, variations in performance of printer 10 may occur as a result of ambient temperature changes and changes in heat emitted by heater 10 because there is no measurement of and compensation for temperature changes of receiver 60 in the open-loop control system comprising this first embodiment of the present invention. Moreover, changes in heater performance may occur due to electrical resistance of heating element 30 changing over time resulting from heater aging.

Figure 4:
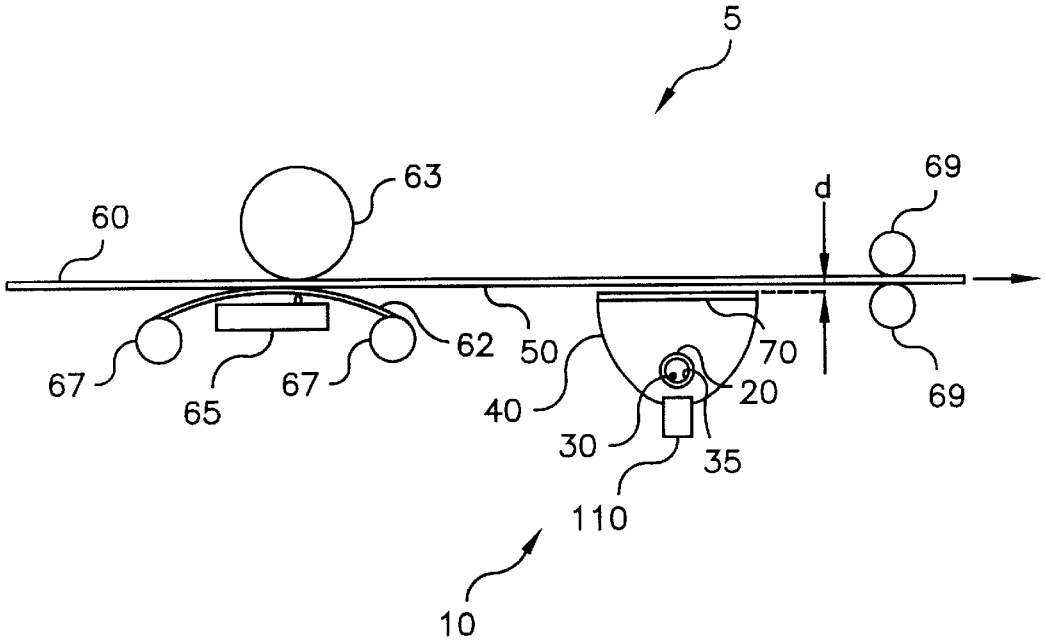
FIG. 4 is a view in elevation of of the radiant heater, reflector and a receiver according to a second embodiment of the invention.

Therefore, referring to FIG. 4, there is shown a second embodiment non-contact heater 10. In this second embodiment of the invention, reflector 40 includes a temperature sensor 110 for more accurately controlling the temperature of receiver 60 to improve the repeatability of its heating function as well as to prevent excessive heating or burning of receiver 60. Temperature sensor 110 may be a thermistor, a thermocouple, or other commonly used temperature sensor, such as temperature sensors comprising silicon material.

Figure 5:
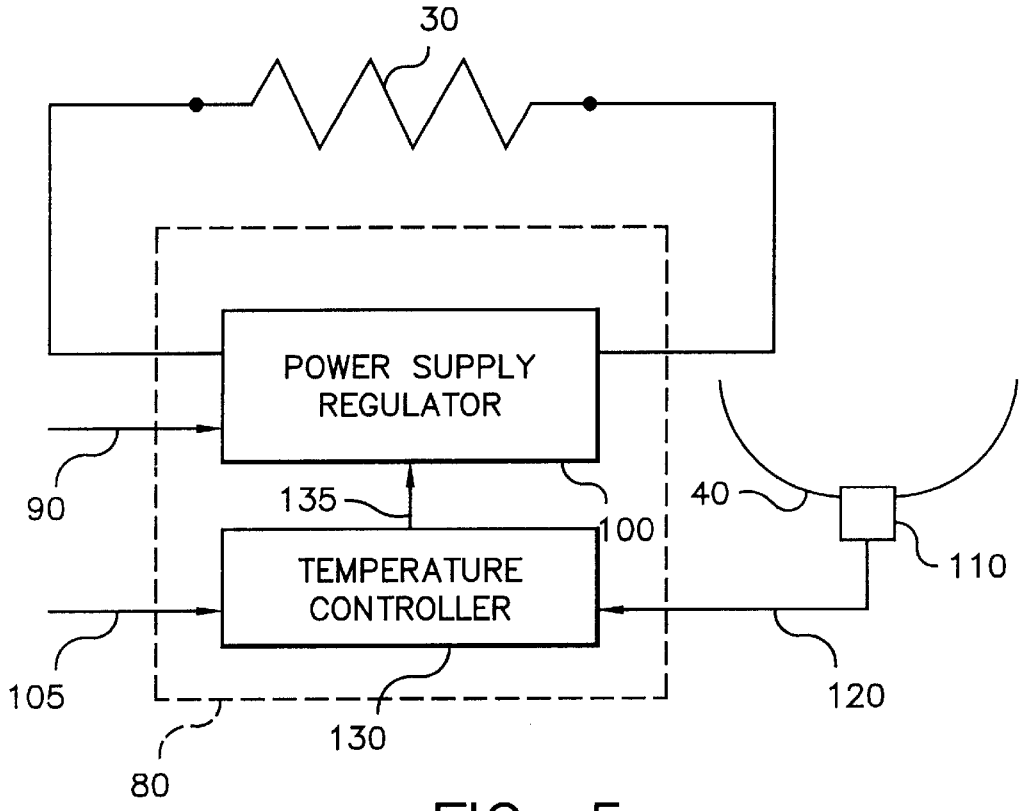
FIG. 5 is a schematic showing a second embodiment heater control arrangement for the radiant heater and reflector.

Moreover, referring to FIG. 5, a heater control arrangement 80 is shown for controlling the heat generated by heating element 30. In this second embodiment, heater control arrangement 80 is a closed-loop system for accurately controlling the temperature of receiver 60. Similar to the heater control arrangement illustrated in FIG. 3, power supply regulator 100 converts the input voltage to a direct or alternating voltage or current for heating element 30. However, according to the second embodiment of of the invention, the temperature produced by the heating element 30 is measured by temperature sensor 110 and a corresponding input signal 120 is provided as a feedback signal to a temperature controller 130. Temperature controller 130 generates an output signal 135 in response to input signal 120. Output signal 135 is received by power supply regulator 100. Control signals 105 allow a printer control system (not shown) to select an operating temperature or alternatively inhibit operation of heating element 30 when not in use. This second embodiment of the invention significantly reduces radiant temperature variations due to heater aging and ambient temperature changes.

Figure 6:
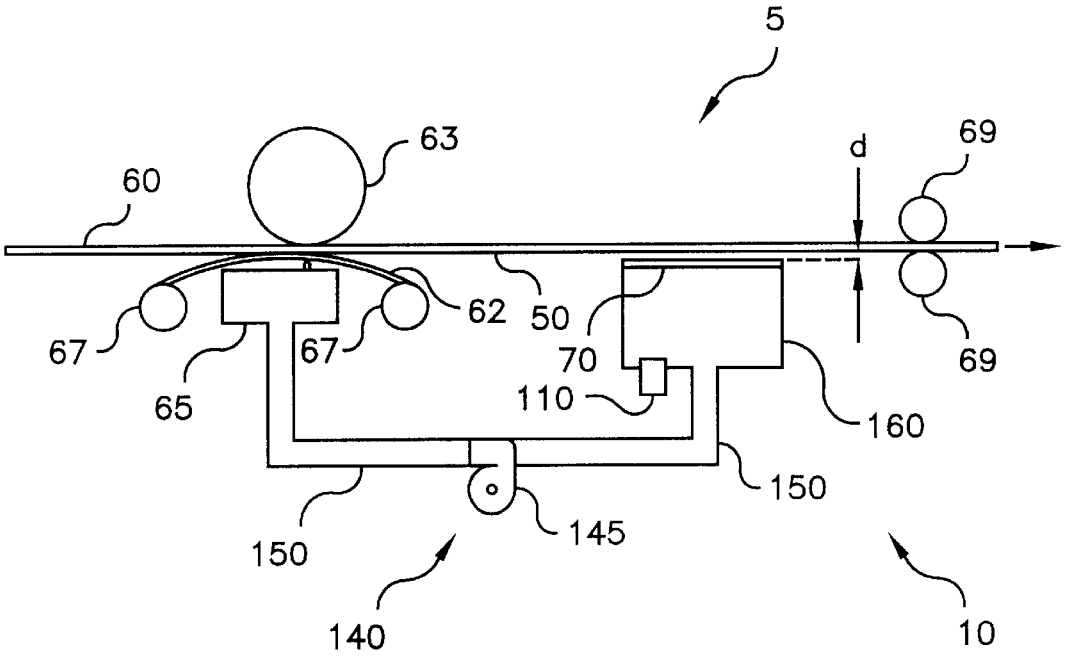
FIG. 6 is a view in elevation of of a heater blower and receiver according to a third embodiment of the invention.

Turning now to FIG. 6, there is shown a third embodiment of the invention. In this third embodiment of the invention, heater 10 is shown comprising a blower assembly, generally referred to as 140, for reasons disclosed immediately hereinbelow. Blower assembly 140 includes a blower 145 in fluid flow communication, via conduit 150, both with printhead 65 and an air chute 160. Blower 145 provides forced convection of air from printhead 65 to receiver 60. Hence, waste heat, which is generated by printhead 65, is channeled into chute 160 and thence transferred onto receiver 60. In this embodiment of the invention, the amount of heated air flowing to receiver 60 is controlled by controlling blower 145. Furthermore, temperature sensor 110 can be installed in the air chute 160 for more accurate temperature control. An advantage of this third embodiment of the invention is that it is energy efficient because heat energy otherwise lost to the surrounding atmosphere is instead harvested and used to heat receiver 60. In addition, it is appreciated that this embodiment can be easily combined with the embodiments illustrated taught in FIGS. 2 and 4 of the present invention.

In each of the examples described hereinbelow, radiant heater 10 was used for post-print heat treatment of receiver 60. The length of radiant heater 10 was approximately 22 cm. Heater 10 was disposed across the width of a page size receiver 60, which had dimensions of approximately 21.59 cm×27.94 inches. Radiant heater 10 was approximately 1.5 cm wide. Transport mechanism 69 transported receiver 60 across heat radiated from heater 10 at approximately 0.393 cm/sec. The energy density received by receiver 60 by means of the thermal radiation was approximately 8.7 J/cm$^2$.

It is appreciated that, in either of the first or second embodiments disclosed herein, heater 10, if desired, may be activated either before printhead 65 is activated, during activation of printhead 65, or during intervals printhead 65 is deactivated. In addition, the heat treatment of receiver 60 containing the printed image can be implemented in any of many different formats. For example, heating can occur during the printing pass for each color plane (yellow, magenta, cyan or black), or during the printing pass of the last color plane (e.g. the black patch). Since heating can take place while the lower portion of a page is still being printed, no extra time is added to the printing process, which is advantageous compared to prior art techniques. With these configurations in mind, examples of use of the invention are provided hereinbelow.

Dye Structures:

Various dye structures were used with the invention. Dyes 1 and 2 disclosed hereinbelow, are examples of deprotonated cationic dyes used in the invention.

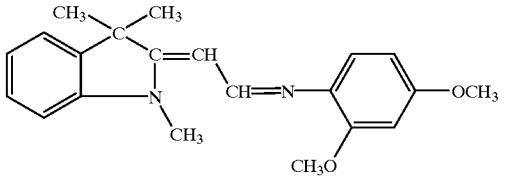

Dye 1
Imax 379nm(-aad)/420nm(taad)
yellow/yellow

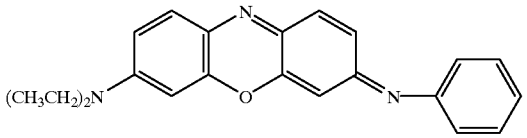

Dye 2
Imax 556nm(-aad)/641nm(taad)
magenta/cyan

Acid Sources

A plurality of acid sources were used with the invention, as follows:

A-1: Poly[isophthalate-co-5-sulfoisophthalic acid, ammonium salt (90:10 molar ratio)-diethylene glycol (100 molar ratio)],
Mw=20,000

A-2: $Al_2(SO_4)_3$-$18H_2O$, hydrated aluminum sulfate

Polymeric Binders:

A plurality of polymeric binders were used with the invention as follows:

P-1: poly(butylacrylate-co-allyl methacrylate-co-2-sulfoethyl methacrylate, sodium salt) 93:2:5 wt. core/poly (glycidyl methacrylate) 10 wt. shell, (Tg=−40° C.)

P-2: Poly[isophthalate-co-5-sulfoisophthalic acid, sodium salt(90:10 molar ratio)-diethylene glycol (100 molar ratio)]

P-3 Poly(ethyl acrylate-co-fluoroalkylmethacrylate-co-2-acrylamido-2-methylpropane sulfonic acid, sodium salt) (50:45:5 wt. ratio)

Preparation of Dye Donor Elements

Individual dye-donor elements 62 were prepared by providing a coating on a 6 mm poly(ethylene terephthalate)

support as follows: 1) a subbing layer of Tyzor TBTtm, a titanium tetrabutoxide, (duPont Company) (0.13 g/m$^2$) coated from 1-butanol/propyl acetate (15/85 wt %); and 2) a dye layer containing the dyes described above, coated in mixtures of bisphenol A epichlorohydrin copolymer (DB-1, phenoxy resin from SP[2]) and poly (butyl methacrylate-co-Zonyl TM) 50:50 wt (DB-2, Zonyl is a monomer from DuPont) binders, coated from a tetrahydrofuran and cyclopentanone mixture (95/5) with no surfactant. Details of dye and binder laydowns are provided in Table 1 below.

TABLE 1

| Dye | Dye Laydown, g/m$^2$ | DB-1 Laydown, g/m$^2$ | DB-2 Laydown, g/m$^2$ |
|---|---|---|---|
| 1 | 0.28 | 0.27 | 0.07 |
| 2 | 0.15 | 0.18 | 0.05 |

The back side of the dye-donor element was coated as follows:

1) a subbing layer of Tyzor TBTtm, a titanium tetrabutoxide, (duPont Company) (0.13 g/m$^2$) coated from 1-butanol/propyl acetate (15/85 wt %); and
2) a slipping layer of 0.38 g/m$^2$ poly(vinyl acetal) (Sekisui), 0.022 g/m$^2$ Candelilla wax dispersion (7% in methanol), 0.011 g/m$^2$ PS513 amino-terminated polydimethylsiloxane (Huels) and 0.0003 g/m$^2$ p-toluenesulfonic acid coated from 3-pentanone (98%)/distilled water (2%) solvent mixture.

Preparation of Dye Receiving Elements

A subbing layer coating solution for dye receiver 60 was prepared by dissolving Prosil 221 and Prosil 2210(PCR Corp.)(each at 0.055 g/m$^2$) which are amino- and epoxy-functional organo-oxysilanes, respectively, in an ethanol/methanol/water solvent mixture. The resulting test solution contained approximately 1% silane component, 1% water, and 98%3A alcohol. This solution was coated onto a support of Oppalyte-laminated paper support with a $TiO_2$-pigmented polypropylene skin at a total dry coverage of 0.11 g/m$^2$. Prior to coating, the support had been subjected to a corona discharge treatment at approximately 450 joules/m$^2$.

Receiver Element E-1:

A first dye receiving layer was composed of a mixture of 2.42 g/m$^2$ of acid source A-1, 0.10 g/m$^2$ succinic acid, and 3.42 g/m$^2$ of polymer P-1, 0.09 g/m$^2$ of styrene butylacrylate divinylbenzene beads, as well as 0.02 g/m$^2$ of surfactant ethoxylated alkylphenols under the product name of SYN FAC 8216, available from Milliken Chemical Company, located in South Carolina, USA.

Receiver Element E-2:

A second dye receiving layer was composed of a mixture of 0.53 g/m$^2$ of acid source A-2, 2.88 g/m$^2$ of polymer P-1, and 1.45 g/m$^2$ P-2, 0.22 g/m$^2$ of P-3, as well as 0.48 g/m$^2$ each of SYN FAC 8216 surfactant and Carnauba wax under the product name of "ML-160", available from Michelman Company, located in Ohio, USA, and was coated from distilled water.

Preparation and Evaluation of Thermal Dye Transfer Images.

"Eleven-step" sensitometric thermal dye transfer images were prepared from these dye-donors 62 and dye-receivers 60. The dye side of the dye-donor element of approximately 10 cm×15 cm in area was placed in contact with a receiving-layer side of a dye-receiving element of the same area. This assemblage was clamped to a stepper motor-driven, 60 mm diameter rubber roller (not shown). A thermal printhead 65 having a resolution of 5.4 dots/mm, thermally controlled at 25° C. was used. The printhead 65 was exerted with a force of 24.4 Newtons (2.5 kg) against the dye donor element side of the assemblage, pressing it against the rubber roller.

Imaging electronics (not shown) were activated causing the donor-receiver assemblage to be drawn through the printing head/roller nip at 38.3 mm/sec. Coincidentally, the resistive elements in thermal printhead 65 were pulsed for 127.75 microsec/pulse at 130.75 microsec intervals during a 4.575 msec/dot printing cycle (including a 0.391 msec/dot cool down interval). A stepped image density was generated by incrementally increasing the number of pulses/dot from a minimum of 0 to a maximum of 32 pulses/dot. The voltage supplied to thermal printhead 65 was approximately 12.0 volts resulting in an instantaneous peak power of 0.289 watts/dot and a maximum total energy of 1.18 mJ/dot. Ambient relative humidity was approximately 44%.

For images containing a cyan dye (cyan or green image), the rate of protonation is proportional to the rate of hue shift from the deprotonated cyan dye form (magenta) to the protonated cyan dye form (cyan). This hue shift was monitored by measuring Status A red (cyan) and green (magenta) densities at various time intervals and calculating the red/green ratio for each time interval.

Complete protonation (conversion) of the cyan dye was equivalent to the red/green ratio after incubating prints at 50° C./50%RH for 3 hours and the percentage of dye conversion was calculated.

After printing, dye-donor element 62 was separated from image receiving element 50. The Status A reflection red and green densities at maximum print density in the stepped-image were measured for the cyan and green channel using a "X-Rite 820" reflection densitometer (available from X-Rite Corp., located in Grandville, Mich.). After approximately 2 to 3 minutes waiting at room temperature, the prints were then exposed to radiant heat of different levels using radiant heater 10. The surface temperature on the receiver is measured to be in the range of approximately 65° C. to 85° C. by a thermal strip, such as "CelsiStrip" available from Solder Absorbing Technology, Incorporated, located in Massachusetts, USA. The red and green densities were then read again by the X-Rite 820 reflection densitometer. A red/green (R/G) ratio (minus the baseline) was calculated for the cyan and green images in each receiver for different heat treatment and the percent dye conversion for the cyan dye in the cyan and green images was calculated assuming the incubated R/G ratios represented 100% dye conversion. The results are summarized in Table 2 hereinbelow.

TABLE 2

Effect Of Radiant Heating On Dye Conversion Rate

| Receiver Elements | Treatment Description | Cyan R/G | Channel % dye conv. | Green R/G | Channel % dye conv. |
|---|---|---|---|---|---|
| E-1 | no radiant heat exposure | 2.58[1] | 50%[4] | 1.22[1] | 23%[4] |
| | radiant heat at 81° C. | 4.96[2] | 95%[5] | 4.26[2] | 80%[5] |
| | 50° C./50% RH, 3 hrs.* | avg. 5.21[3] | | avg. 5.34[3] | |
| E-1 | no radiant heat exposure | 2.58 | 50% | 1.26 | 24% |
| | radiant heat at 79° C. | 4.70 | 90% | 4.26 | 80% |
| | 50° C./50% RH, 3 hrs. | avg. 5.21 | | avg. 5.34 | |
| E-1 | no radiant heat exposure | 2.50 | 48% | 1.24 | 23% |
| | radiant heat at 68° C. | 4.48 | 86% | 2.81 | 53% |
| | 50° C./50% RH, 3 hrs. | avg. 5.21 | | avg. 5.34 | |

TABLE 2-continued

Effect Of Radiant Heating On Dye Conversion Rate

| Receiver Elements | Treatment Description | Cyan R/G | Channel % dye conv. | Green R/G | Channel % dye conv. |
|---|---|---|---|---|---|
| E-2 | no radiant heat exposure | 2.31 | 44% | 1.21 | 25% |
| | radiant heat at 81° C. | 4.08 | 78% | 4.25 | 82% |
| | 50° C./50% RH, 3 hrs. | avg. 5.22 | | avg. 5.20 | |
| E-2 | no radiant heat exposure | 2.26 | 43% | 1.21 | 23% |
| | radiant heat at 79° C. | 3.97 | 76% | 4.08 | 78% |
| | 50° C./50% RH, 3 hrs. | avg. 5.22 | | avg. 5.20 | |
| E-2 | no radiant heat exposure | 2.21 | 42% | 1.21 | 23% |
| | radiant heat at 68° C. | 3.78 | 72% | 2.99 | 58% |
| | 50° C./50% RH, 3 hrs. | avg. 5.22 | | avg. 5.20 | |

*100% dye conversion assumed when receiver elements were incubated at 50° C./50% RH for 3 hrs.
[1]calculated red/green ratio for both cyan and green channels without heat treatment
[2]calculated red/green ratio for cyan and green channels with radiant heat treatment.
Receiver surface temperature reached 81° C.
[3]calculated red/green ratio for cyan and green channels after 3 hours incubation at 50° C./50% RH
[4][R/G ratio, without heat treatment)/(R/G ratio, 3 hrs. incubation at 50° C./50% RH)] × 100 for cyan and green channels
[5][(R/G ratio, with radiant heat treatment at 81° C.)/(R/G ratio, 3 hrs. incubation at 50° C./50% RH)] × 100 for cyan and green channels.

Results shown in Table 2 hereinabove demonstrate that the conversion rate of transferred dye image in dye-receiving elements E-1 and E-2 was significantly improved by use of radiant heat.

The examples described hereinabove used thermal receivers based on the re-protonation of deprotonated cationic dyes, the post-printing heating was intended to improve the surface dye stratification by facilitating the diffusion of the unprotonated dyes into the proximity of available acidic moieties further down into the dye-receiving layer and thus to accelerate the conversion of dyes from the neutral form to the cationic form for obtaining the right color hue. The temperature range required was in the range of approximately 50° C. to 95° C., or more preferably in the range of approximately 120° F. to 185° F.

The temperature range required for post-printing heating for thermal dye chemistry other than NONICAT was typically higher than that disclosed for NONICAT dye chemistry. The maximum surface temperature of the receiving medium was typically higher than approximately 190° F. The purpose of the post-printing heating in these thermal transfer chemistries was to reduce the near-surface dye concentration by facilitating the diffusion of surface dyes further into a hydrophobic, dye-receiving layer.

An advantage of the present invention is that the rate of dye conversion is accelerated. This is so because, as shown in Table 2 hereinabove, radiant heat, when used in accordance with the invention, consistently obtained higher dye conversion rates as compared to non-radiant heating.

Another advantage of the present invention is the prevention of image artifacts. This is so because a fuser roller is not present to cause scratching and blistering of the receiver.

A further advantage of the present invention is that the media cost and printing time are reduced compared to prior art techniques.

The invention has been described in detail with particular reference to certain preferred embodiments thereof, but it will be understood that variations and modifications can be effected within the spirit and scope of the invention. For example, printing efficiency can be further improved by selecting the printing sequence of the color planes. In this regard, colored dyes with slower dye conversion rates can be printed prior to the colored dyes with more rapid conversion rate. This allows more time for extensive auxiliary heating of the slower converting dyes. As another example, non-contact heater 10 can exist in other configurations. In this regard, hot air from a heating device can be moved across thermal receiver 60 by natural convection. As yet another example, non-contact heater 10 may be installed upstream or downstream of printhead 65 (i.e., relative to the travel direction of the receiver 60) to accommodate convenient arrangement of internal components within printer 5.

Therefore, what is provided is a resistive thermal printer apparatus and method having a non-contact heater for eliminating image artifacts.

PARTS LIST

5 printer
10 radiant heater
20 tube
30 heating element
35 bore
40 reflector
50 image side
60 receiver
62 dye donor
63 platen roller
65 resistive thermal printhead
67 dye donor transport mechanism
69 receiver transport mechanism
70 cover
80 heater control arrangement
90 power line
100 power supply regulator
105 control signals
110 temperature sensor
120 input signal
130 temperature controller
135 output signal
140 blower assembly
145 blower
150 conduit
160 air chute

What is claimed is:

1. A printer, comprising:

(a) a thermal resistive printhead for transferring a colorant to a receiver;

(b) a heater disposed in non-contact heat transfer communication with the receiver for heating the receiver, so that the colorant is conveyed into the receiver; and (c) a heat transfer assembly extending from said printhead to adjacent the receiver for transferring waste heat from said printhead to the receiver.

2. The printer of claim 1, wherein said heater is spaced-apart from the receiver for preventing contact therebetween, so that the receiver is scratch-free.

3. The printer of claim 1, further comprising a receiver transport mechanism capable of engaging the receiver and transporting the receiver adjacent to said heater.

4. The printer of claim 1, wherein said heat transfer assembly comprises a blower in communication with said printhead and the receiver for forced-convection transfer of the waste heat.

5. The printer of claim 1, further comprising a temperature sensor associated with the receiver for sensing temperature of the receiver.

6. The printer of claim 1, further comprising a protect or surrounding said heater for protecting said heater from damage.

7. The printer of claim 6, wherein said protector is formed of quartz.

8. The printer of claim 1, further comprising a heater control arrangement connected to said heater for controlling said heater.

9. The printer of claim 8, wherein said heater control arrangement comprises a power supply regulator for regulating electrical power supplied to said heater.

10. The printer of claim 8, wherein said heater control arrangement comprises:

(a) a power supply regulator connected to said heater for regulating electrical power supplied to said heater;

(b) a temperature sensor associated with said receiver for sensing temperature of the receiver; and (c) a temperature controller connected to said power supply regulator and said temperature sensor for controlling said power supply regulator in response to temperature sensed by said temperature sensor.

11. The printer of claim 1, wherein said heater comprises a heating element capable of radiating heat therefrom.

12. The printer of claim 11, further comprising a reflector for reflecting heat radiated from said heating element onto the receiver.

13. The printer of claim 11, wherein said heating element is a wire member.

14. The printer of claim 12, wherein said reflector is parabola-shaped for focusing the heat radiating from said heating element.

15. The printer of claim 12, wherein said reflector is polished for reflecting the heat at high thermal efficiency.

16. The printer of claim 12, wherein said reflector is light-weight aluminum for ease of portability and strength.

17. The printer of claim 13, wherein said wire member is spirally-wound for increasing heating surface area thereof.

18. A method of providing a printer, comprising the steps of:

(a) providing a thermal resistive printhead for transferring a colorant to a receiver;

(b) providing a heater disposed in non-contact heat transfer communication with the receiver for heating the receiver, so that the colorant is conveyed into the receiver; and (c) providing a heat transfer assembly extending from the printhead to adjacent the receiver for transferring waste heat from the printhead to the receiver.

19. The method of claim 18, wherein the step of providing a heater comprises the step of providing a heater spaced-apart from the receiver for preventing contact therebetween, so that the receiver is scratch-free.

20. The method of claim 18, further comprising the step of providing a receiver transport mechanism capable of engaging the receiver and transporting the receiver adjacent to the heater.

21. The method of claim 18, wherein the step of providing a heat transfer assembly comprises the step of providing a blower in communication with the printhead and the receiver for forced-convection transfer of the waste heat.

22. The method of claim 18, wherein the step of providing a heater comprises the step of providing a heater adapted to heat the receiver after the printhead applies dye to the receiver.

23. The method of claim 18, wherein the step of providing a heater comprises the step of providing a heater adapted to heat the receiver before the printhead applies dye to the receiver.

24. The method of claim 18, wherein the step of providing a heater comprises the step of providing a heater adapted to heat the receiver as the printhead applies dye to the receiver.

25. The method of claim 18, wherein the step of providing a printhead comprises the step of providing a printhead adapted to print a plurality of color planes of mordanting dyes by printing a first colored dye having a first dye conversion rate followed by printing a second colored dye having a second conversion rate slower than the first dye conversion rate.

26. The method of claim 18, further comprising the step of providing a temperature sensor associated with the receiver for sensing temperature of the receiver.

27. The method of claim 18, further comprising the step of providing a protector surrounding the heater for protecting the heating element from damage.

28. The method of claim 27, wherein the step of providing a protector comprises the step of providing a protector formed of quartz.

29. The method of claim 18, wherein the step of providing a heater comprises the step of providing a heating element capable of radiating heat therefrom.

30. The method of claim 29 further comprising the step of providing a heater control arrangement connected to the heater for controlling the heater.

31. The method of claim 29, further comprising the step of providing a reflector for reflecting heat radiated from the heating element onto the receiver.

32. The method of claim 29, wherein the step of providing a heating element comprises the step of providing a heating element formed of a wire member.

33. The method of claim 30, wherein the step of providing a heater control arrangement comprises the step of providing a power supply regulator for regulating electrical power supplied to the heating element.

34. The method of claim 30, wherein the step of providing a heater control arrangement comprises the steps of:

(a) providing a power supply regulator connected to the heater for regulating electrical power supplied to the heater;

(b) providing a temperature sensor associated with said reflector for sensing temperature of the receiver; and (c) providing a temperature controller connected to the power supply regulator and the temperature sensor for controlling the power supply regulator in response to temperature sensed by the temperature sensor.

35. The method of claim 31, wherein the step of providing a reflector comprises the step of providing a parabola-shaped reflector for focusing the heat radiating from the heating element.

36. The method of claim 31, wherein the step of providing a reflector comprises the step of providing a polished reflector for reflecting the heat at high thermal efficiency.

37. The method of claim 31, wherein the step of providing a reflector comprises the step of providing a reflector formed of light-weight aluminum for ease of portability and strength.

38. The method of claim 32, wherein the step of providing a wire member comprises the step of providing spirally-wound wire member for increasing heating surface area thereof.

* * * * *